US005498357A

United States Patent [19]

Naka et al.

[11] Patent Number: 5,498,357

[45] Date of Patent: Mar. 12, 1996

[54] GREASE COMPOSITION FOR HIGH-TEMPERATURE, HIGH-SPEED AND HIGH-LOAD BEARINGS

[75] Inventors: Michiharu Naka, Odawara; Hideki Koizumi, Chigasaki; Yuzo Takahashi, Fujisawa; Koici Goto, Okazaki; Toshiaki Endo, Fujisawa; Yoichi Suzuki, Chigasaki, all of Japan

[73] Assignees: NSK Ltd.; Kyodo Yushi Co., Ltd., Tokyo, Japan

[21] Appl. No.: 173,607

[22] Filed: Dec. 27, 1993

Related U.S. Application Data

[63] Continuation of Ser. No. 875,466, Apr. 29, 1992, abandoned, which is a continuation of Ser. No. 827,035, Jan. 29, 1992, abandoned.

[30] Foreign Application Priority Data

Oct. 4, 1991 [JP] Japan ..... 3-257855

[51] Int. Cl.$^6$ ..... C10M 133/20

[52] U.S. Cl. ..... 252/51.5 R; 252/52 R; 252/33; 252/56 R; 252/52 A; 252/33.6

[58] Field of Search ..... 252/51.5 R, 52 R, 252/33, 56 R, 52 A, 33.6, 33.2, 51.5 A

[56] References Cited

U.S. PATENT DOCUMENTS

| | | | |
|---|---|---|---|
| 3,082,170 | 3/1963 | McCarthy et al. . | |
| 3,920,571 | 11/1975 | Crocker . | |
| 3,929,650 | 10/1975 | King et al. | 252/33.4 |
| 3,983,041 | 9/1976 | Abbott . | |
| 4,115,284 | 9/1978 | Kinoshita et al. . | |
| 4,261,844 | 4/1981 | Caruso | 252/51.5 A |
| 4,780,231 | 10/1988 | Kinoshita et al. | 252/51.5 A |
| 4,787,992 | 12/1988 | Waynick | 252/18 |
| 4,830,767 | 5/1989 | Waynick | 252/52 R |
| 4,902,435 | 2/1990 | Waynick | 252/18 |
| 5,000,862 | 3/1991 | Waynick . | |
| 5,084,193 | 1/1992 | Waynick | 252/51.5 R |
| 5,145,591 | 9/1992 | Kinoshita et al. | 252/51.5 R |

FOREIGN PATENT DOCUMENTS

| | | |
|---|---|---|
| 0414191 | 2/1991 | European Pat. Off. . |
| 2304662 | 10/1976 | France . |
| 1-259097 | 10/1989 | Japan . |
| 3028299 | 2/1991 | Japan . |
| 3-210394 | 9/1991 | Japan . |
| 3-200898 | 9/1991 | Japan . |
| 3-250094 | 11/1991 | Japan . |

OTHER PUBLICATIONS

Catalog entitled "Synthetic Lubricant Greases"–distributed in Aug., 1991 by Kyodo Yushi Co., Ltd.

Database WPIL, Week 8947, Derwent Publications Ltd., London, GB; AN 89–345397 & JP–A–1 259 097 (Kyodo Yushi KK), Oct. 1989.

Database WPIL, Week 9141, Derwent Publications Ltd., London, GB; AN 91–300349 & JP–A–3 200 898 (Kyodo Yushi KK), Sep. 1991.

*Primary Examiner*—Prince Willis, Jr.
*Assistant Examiner*—Alan D. Diamond
*Attorney, Agent, or Firm*—Evenson, McKeown, Edwards & Lenahan

[57] ABSTRACT

A grease composition for high-temperature, high-speed and high-load bearings comprises (i) a lubricating base oil composed of an alkyldiphenyl ether lubricant as an essential ingredient and having a kinematic viscosity of 90–160 cSt at 40° C., and (ii) 22–30 wt. %, based on the grease composition, of a diurea compound as a thickener. The diurea compound is represented by the following formula:

$$R_1-NHC(=O)NH-R_2-NHC(=O)NH-R_3$$

wherein $R_2$ means an aromatic hydrocarbon group having 6–15 carbon atoms, $R_1$ and $R_3$ denote an aromatic hydrocarbon group having 6–12 carbon atoms or a linear alkyl group having 8–20 carbon atoms, and the proportion of aromatic hydrocarbon groups in $R_1$ and $R_3$ is 70–95 mole %. The NLGI thickness grade of said composition is in a range of from No. 1 to No. 3.

10 Claims, No Drawings

GREASE COMPOSITION FOR HIGH-TEMPERATURE, HIGH-SPEED AND HIGH-LOAD BEARINGS

CROSS-REFERENCE TO RELATED APPLICATION

This application is a continuation of Ser. No. 07/875,466, filed Apr. 29, 1992 now abandoned, which is a continuation of Ser. No. 07/827, 035, filed Jan. 29, 1992 now abandoned.

BACKGROUND OF THE INVENTION

1. Field of the Invention

Keeping step with recent innovations and developments in machine technology, bearings employed in various machine parts are subjected to ever severer usage conditions. In particular, bearings used in automotive electrical components such as alternators, electromagnetic clutches and idler pulleys are exposed to very severe usage conditions, including higher temperatures due to improvements in the performance of engines as heat-generating elements, higher speeds due to improvements in the performance of parts and higher loads due to increases in belt tension. These bearings also face the problem of rusting due to penetration of salt water or sea water. The present invention relates to a lubricating grease composition useful in such high-temperature, high-speed and high-load bearings.

2. Description of the Related Art

Greases which have heretofore been employed in such high-temperature, high-speed and high-load bearings are those using, as a thickener, a diurea compound containing cyclohexyl groups as predominant end groups and, as a base oil, a poly-α-olefin lubricant.

With the ever severer usage conditions, such conventional diurea greases containing cyclohexyl groups as predominant end groups are prematurely softened under high-temperature and high-speed conditions so that their leakage from bearings increase. Moreover, the poly-α-olefin lubricant is close to its maximum in heat resistance and oxidative stability so that it has become difficult to obtain satisfactory lubricating life with greases containing the lubricant as a base oil. In addition, the conventional greases involve the problem that bearings undergo premature flaking. Effective for the improvement of these problems are greases which use, as a thickener, a diurea compound containing aromatic groups as predominant end groups out of those disclosed in Japanese Patent Application Laid-Open (Kokai) No. HEI 1-259097 and, as a base oil, an alkyldiphenyl ether lubricant. Greases making use of this thickener are, however, accompanied by the problems that they are inferior in fluidity and, under high load conditions, no sufficient greases are allowed to flow into lubricated parts and bearings are seized prematurely.

SUMMARY OF THE INVENTION

An object sought for attainment by the present invention is, therefore, to provide a grease composition which has not only long lubricating service life under high-temperature and high-speed conditions but also long service life without premature seizure even under high-load conditions and does not cause premature flaking of bearings. Such bearing greases for electrical components are also required to have rust inhibiting property in view of possible penetration of salt water and sea water. It is another object of this invention to attain such rust inhibiting property.

The present invention has been completed as a result of an extensive investigation conducted with a view toward solving the problems described above.

The present invention relates, in a first aspect, to a grease composition for high-temperature, high-speed and high-load, comprising:

(i) a lubricating base oil composed of an alkyldiphenyl ether lubricant as an essential ingredient and having a kinematic viscosity of 90–160 cSt at 40° C., and (ii) 22–30 wt. %, based on the grease composition, of a diurea compound as a thickener, said diurea compound being represented by the following formula:

$$R_1-NHC(=O)NH-R_2-NHC(=O)NH-R_3$$

wherein $R_2$ means an aromatic hydrocarbon group having 6–15 carbon atoms, $R_1$ and $R_3$ denote an aromatic hydrocarbon group having 6–12 carbon atoms or a linear alkyl group having 8–20 carbon atoms, and the proportion of aromatic hydrocarbon groups in $R_1$ and $R_3$ is 70–95 mole %; and the NLGI thickness grade of said composition being in a range of from No. 1 to No. 3.

Preferably, the grease composition further comprises a rust inhibiting additive composed of (i) an organosulfonate salt, (ii) a nitrite and (iii) a non-ionic surfactant, whose HLB is 1.5–9, each in an amount of 0.1–10 wt. % based on the grease composition.

The grease composition according to the present invention can show satisfactory performance when used in bearings of automotive electrical components, such as alternators, to which conventional greases have become no longer applicable due to still severer usage conditions of high temperatures, high speeds and high loads. The grease composition of this invention also shows superb rust inhibiting property even under severe conditions.

DETAILED DESCRIPTION OF THE INVENTION AND PREFERRED EMBODIMENTS

The alkyldiphenyl ether lubricant used in the grease composition according to this invention is obtained by an addition reaction between 1 mole of diphenyl ether and 1–3 moles of an a-olefin having 10–22 carbon atoms. The alkyldiphenyl ether lubricant is a colorless-to-yellow, clear liquid and is a known substance by itself, although its properties vary depending on the carbon number and added mole number of the α-olefin. Regarding alkyldiphenyl ether lubricants, disclosed are rotary pump oils containing an alkyldiphenyl ether lubricant as an essential ingredient in Japanese Patent Publication (Kokoku) No. SHO 51-44263, sea-water-resistant working oils in Japanese Patent Publication (Kokoku) No. SHO 52-1722, diffusion pump oils in Japanese Patent Publication (Kokoku) No. SHO 52-24628, and chain-lubricating oils in Japanese Patent Publication (Kokoku) No. SHO 58-22515. Further, greases containing an alkyldiphenyl ether lubricant as an essential ingredient are disclosed in Japanese Patent Application Laid-Open (Kokai) Nos. Hei 1-259097 and 3-28299. The kinematic viscosity at 40° C. is limited to 90–160 cSt in the present invention, because kinematic viscosities lower than 90 cSt result in marked premature flaking of bearings while kinematic viscosities higher than 160 cSt lead to grease compositions having large agitation resistance at low temperatures to impair the start-up readiness of bearings so that the grease compositions are not suited for practical applications. Although no particular limitation is imposed on the content of the alkyldiphenyl ether lubricant in the present invention, its content may preferably be 50 wt. % or more based on the base oil in order to obtain a grease having long life at elevated temperatures. In this case, the base oil usable in combination can be, for example, a mineral oil, a synthetic ester lubricant, a synthetic hydrocarbon lubricant, or a synthetic phenyl ether lubricant other than alkyldiphenyl ether lubricants.

Further, the diurea compound as a thickener, which is represented by the formula described above, is generally obtained by a reaction between a diisocyanate and a monoamine. The diurea compound is limited to that containing aromatic groups as predominant end groups in the present invention, thereby minimizing premature leakage from a bearing under high-temperature and high-speed conditions. In addition, to cope with premature seizure of a bearing under high load conditions due to insufficient fluidity which is a drawback of thickeners of this type, linear alkyl groups are also introduced as an essential requirement to end groups in the present invention so that the above problem has been solved. The proportion of such aromatic hydrocarbon groups in $R_1$ and $R_3$ is specified to range from 70 mole % to 95 mole %, because proportions smaller than 70 mole % impart too much fluidity so that greater grease leakage takes place to shorten the lubricating life under high temperature conditions and proportions in excess of 95 mole % lead to greases with no substantial fluidity so that premature seizure of a bearing may take place under high load conditions. Moreover, the content of the diurea compound is limited to 22–30 wt. % based on the grease composition and the NLGI thickness grade is limited to the range of No. 1 to No. 3, in other words, the thickness is limited to the range of 340–220, since the initial leakage becomes great under high-temperature and high-speed conditions if the content is less than 22 wt. % or the thickness is lower than No. 1. and the agitation resistance of a grease at low temperatures become large to impair the start-up readiness of a bearing if the content exceeds 30 wt. % or the thickness becomes greater than No. 3. For these reasons, the particularly preferred content and thickness ranges from 24 wt. % to 28 wt. % and from 310 to 250, respectively.

Examples of the diisocyanate which becomes $R_2$ after the above reaction include aromatic isocyanates such as 2,4-tolylene diisocyanate, 2,6-tolylene diisocyanate, diphenylmethane-4,4'-diisocyanate and naphthylene-1,5-diisocyanate as well as mixtures thereof. Illustrative of the monoamine which becomes $R_1$ and $R_3$ include aromatic amines such as aniline, benzylamine, toluidine and chloroaniline as well as linear amines such as octylamine, nonylamine, decylamine, undecylamine, dodecylamine, tridecylamine, tetradecylamine, pentadecylamine, hexadecylamine, heptadecylamine, octadecylamine, nonyldecylamine and eicosylamine.

The preferred grease composition according to this invention features the additional incorporation of the rust inhibiting additive, namely, the organosulfonate salt as an oil-soluble rust inhibitor, the nitrite as a water-soluble rust inhibitor and the non-ionic surfactant, each in an amount of 0.1–10 wt. % based on the grease composition. An organosulfonate salt is generally represented by $RSO_3$-M. Examples of $RSO_3$ on the acid side include residua of petroleum sulfonic acids and dinonylnaphthalenesulfonic acid, while examples of M on the alkali side include metals such Ba, Ca, Zn, Pb, Na and Li, $NH_4^+$, and residua of amines such as $H_2N(CH_2)_2NH_2$. Illustrative of the nitrite includes sodium nitrite. Sodium nitrite is commercially available in forms combined with a surfactant so that its dispersion in oil has been improved (hereinafter referred to as a "sodium nitrite dispersion"). They are also usable. Examples of the non-ionic surfactant whose HLB is 1.5–9 include ester compounds such as glycerin fatty acid esters, polyglycerin fatty acid esters, sorbitan fatty acid esters, pentaerythritol fatty acid esters and polyoxyethylene fatty acid esters as well as ether compounds such as polyoxyethylene alkylphenyl ether. The effectiveness of this rust inhibitor formulation is disclosed in Japanese Patent Application Laid-Open (Kokai) No. HEI 3-200898. The addition of this rust inhibitor formulation can provide a grease which is still better as a bearing grease for automotive electrical components.

In addition, the grease composition according to the present invention can be added further with additives such as oxidation inhibitors, extreme pressure additives, oiliness agents and solid lubricants as well as corrosion inhibitors led by benzotriazole, as needed.

According to the present invention, a grease composition comprises a lubricating base oil composed of an alkyldiphenyl ether lubricant as an essential ingredient and having a kinematic viscosity of 90–160 cSt at 40° C.; and, as a thickener, 22–30 wt. % of a diurea compound represented by the formula described above. The NLGI thickness grade of the grease composition is in the range of from No. 1 to No. 3. Even under high-temperature and high-speed conditions, the grease composition does not develop much initial leakage from a bearing and, therefore, has long life. In addition, the grease composition has solved premature flaking of bearings, does not cause premature seizure even under high-load conditions, and can retain excellent lubricating properties over a long time.

Excellent rust inhibiting properties have also been imparted by adding, as rust inhibitors, an organosulfonate salt, a nitrite and a non-ionic surfactant, whose HLB is 1.5–9, in amounts of 0.1–10 wt. %, respectively. These effects appear to have been brought about for the reasons to be described next.

To reduce initial leakage under high-temperature and high-speed conditions, it is necessary to contain a thickener in a certain amount or more. Since a grease is a mixture of a base oil in the form of a liquid and a thickener in the form of a solid, the grease predominantly reflects properties as a liquid at low thickener contents so that the grease composition is prone to softening and leakage. Compared with other urea-type thickeners and soap-type thickeners, the urea-type thickener employed in this invention, whose end groups are predominantly aromatic groups, has to be added in a greater amount to form a grease of the same hardness. It therefore appears that properties as a liquid are reflected less on the grease, thereby reducing initial leakage. Among such urea-type thickeners, urea greases containing end aromatic groups are excellent in heat resistance and, when combined with an alkyldiphenyl ether lubricant also having excellent heat resistance and oxidation stability, have achieved long life under high-temperature and high-speed conditions.

To obtain sufficient lubricating life even under high load conditions, on the other hand, the flowability of a grease into a lubricated portion is considered to play an important role. A grease which contains as a thickener a diurea compound whose end groups consist of aromatic groups only has long life under such high-temperature and high-speed conditions as described above. Under high-load conditions, however, premature seizure occurs so that the lubricating life is very short. As reasons for this, the grease is probably inferior in fluidity due to the nature of the thickener so that the grease would be inferior in the flowability into a lubricated part. Even with greases of this type, under high-temperature and high-speed conditions, their fluidity can be enhanced by the temperature and speed so that they are probably allowed to flow to a lubricated part. This, however, cannot be expected under high load conditions, whereby a lubricated part may not be supplied with sufficient grease. This is considered as a cause of the seizure. According to the present invention, the introduction of linear alkyl groups in a diurea compound with end groups consisting predominantly of aromatic groups appears to have imparted fluidity to the grease without impairment of its high-temperature and high-speed properties, thereby probably overcoming premature seizure.

With respect to the premature flaking phenomenon of a bearing, correlations can be observed between the premature flaking phenomenon and the kind and amount of the thickener and the viscosity of the base oil. Of these, the correlations between the premature flaking phenomenon and the kind and amount of the thickener are elucidated by Kimura et al. in "Study on Rolling Surfaces of Bearings Lubricated with Urea Greases" [Kimura, Tsuchiya, Suda, and Endo: "Preprint of the 31th Spring Symposium of Japanese Society of Lubrication", 325 (1987)]. It is stated that, different from greases of the metal soap type, a urea grease forms a deposit, which can serve as a cushioning, from a thickener as well as an iron oxide layer on the rolling surface of a bearing and therefore prevents wearing. The anti-flaking effect of the urea grease has also been observed in the present invention and has been found to correlate with the amount of the urea compound. In other words, it has been demonstrated that the frequency of occurrence of flaking becomes lower as the content of the thickener becomes higher. The frequency of occurrence of flaking dropped to zero at thickener contents of 24% and higher. Regarding the base oil, on the other hand, marked flaking takes place with greases having a kinematic viscosity lower than 90 cSt at 40° C. This appears to be attributed to increased chance of direct contact between the balls of a bearing and its races, namely, of boundary lubricating conditions due to a smaller oil film thickness. According to the present invention, the kinematic viscosity of the base oil is specified as 90 cSt or higher at 40° C. so that an effective oil film thickness is believed to be maintained and the use of the urea compound as a thickener in the sufficiently large proportion is believed to give protection to the rolling surfaces of bearings. They seem to have led to the solution of the premature flaking phenomenon of bearings.

Further, as to the rust inhibiting performance required for a grease, excellent performance can be shown owing to the synergistic effects of the organosulfonate salt as an oil-soluble organic rust inhibitor, the nitrite as a water-soluble, inorganic passivating agent and the non-ionic surfactant. The mechanism of their action is disclosed in Japanese Patent Application Laid-Open (Kokai) No. HEI 3–200898.

The present invention will hereinafter be described specifically by examples and comparative examples. The greases in the examples and comparative examples were prepared based on their respective compositions shown in Tables 1(1) to 4(2), following the manner to be described below. Further, performance evaluation tests of the greases were conducted by the following methods.

(A) High-temperature and high-speed leakage test:

A bearing was filled with a grease and was then rotated for 20 hours under the below-described conditions. The amount of leakage was calculated based on a difference between the weight of the bearing before the test and that after the test, and is presented in terms of wt. %.

Bearings: deep-groove ball bearings (17 mm inner diameter×40 mm outer diameter×12 mm width; equipped with a plastic retainer and contact-type rubber seals)

Amount of grease filled: 1.0 g

Revolution speed: 15,000 rpm

Temperature: 180° C.

Load: Fr 10 kgf, Fa 20 kgf (B) High-temperature and high-speed durability test:

A bearing was rotated for 1,000 hours max. under the same conditions as in the test (A), so that the bearing lubricating life was determined in terms of hours.

(C) High-load durability and flaking test:

Bearings (n=5) were filled with a grease and were then rotated for 1,000 hours max. under the conditions given below. With respect to each bearing failed before the completion of the test, the bearing was checked to determine whether the failure was caused due to its seizure life or due to its flaking life.

Bearings: deep-groove ball bearings (17 mm inner diameter×40 mm outer diameter×12 mm width; equipped with a plastic retainer and contact-type rubber seals)

Amount of grease filled: 2.3 g

Revolution speed: 18,000 rpm

Temperature: 110° C.

Load: Fr 200 kgf (D) Start-up torque test:

The start-up torque required at −40° C. was measured in accordance with the low-temperature torque testing method prescribed under JIS K 2220. Judgment was made in accordance with the following standard.

Less than 13,000 gf-cm . . . passed 13,000 gf-cm and more . . . failed (E) Bearing rust inhibition test The bearing rust inhibition test prescribed under ASTM D1743 was followed. Although distilled water is supposed to be used as water for dipping each bearing according to the specification, a 3% aqueous solution of sodium chloride was used in the present invention. Evaluation and judgment was conducted following the specification.

EXAMPLES 1–5 AND 7–10 & COMPARATIVE EXAMPLES 1–10

In each example, half the base oil and half the monoamine shown in the corresponding table were placed in a reaction vessel and heated to 70°–80° C. The remaining halves of the base oil and monoamine were placed in a separate vessel, heated to 70°–80° C., and poured into the reaction vessel, followed by stirring. Although the reaction mixture rose in temperature because of an exothermic reaction, it was continuously stirred for about 30 minutes without cooling. After the reaction proceeded sufficiently, the reaction mixture was heated, held at 170°–180° C. for 30 minutes and then cooled. The rust inhibitor shown in the table was then added in its entirety, followed by the addition of 40 g of alkyldiphenylamine as an oxidation inhibitor. The resulting mixture was kneaded into the desired grease by a three-roll mill.

EXAMPLE 6

A portion (560.4 g) of the base oil (560.4 g) and the entire portion of p-toluidine were placed in a reaction vessel and heated to 70°–80° C. Another portion of the base oil (560.4 g) and the entire portion of TDI were placed in a separate vessel, to 70°–80° C., and then poured into the reaction vessel, followed by stirring. Although the reaction mixture rose in temperature because of an exothermic reaction, it was continuously stirred for about 30 minutes without cooling. After the reaction proceeded sufficiently, the reaction mixture was heated, held at 170°–180° C. for 30 minutes and then cooled. A further portion (129.6 g) of the base oil and the entire portion of octylamine were placed in another reaction vessel and heated to 70°–80° C. A still further portion (129.6 g) of the base oil and the entire portion of MDI were placed in a separate vessel, heated to 70°–80° C. and then poured into the latter reaction vessel. The resulting mixture was stirred and, as in the above, reacted, heated and cooled. The grease so obtained was mixed with the grease prepared above, to which were added the entire portion of the rust inhibitor shown in the table and 40 g of alkyldiphenylamine as an oxidation inhibitor. The resulting mixture was then kneaded into the desired grease by a three-roll mill.

COMPARATIVE EXAMPLE 11

The base oil (1410.0 g) and lithium stearate (500.0 g) were placed in a vessel and heated under stirring to completely melt them at 230° C. After the melt was cooled, the rust inhibitor shown in the table and 40 g of alkyldiphenylamine were added. The mixture so obtained was kneaded into the desired grease by a three roll mill.

Incidentally, TDI shown in Tables 1(1) to 4(2) is an abbreviation of a mixture of 2,4-tolylene diisocyanate and 2,6-tolylene diisocyanate while MDI is an abbreviation of diphenylmethane-4,4'-diisocyanate. Alkyldiphenyl ether whose kinematic viscosity was 97.0 cSt at 40° C. was used as the alkyldiphenyl ether, whereas poly-α-olefins whose kinematic viscosities were 400 cSt and 40 cSt, respectively, were used as poly-α-olefin A and poly-α-olefin B. As the sulfonate rust inhibitor, dinonylnaphthalenesulfonate was used. Employed as the sodium nitrite was that passed through 100 mesh. The sodium nitrite dispersion contained a surfactant in order to facilitate the dispersion of sodium nitrite in an oil system. The surfactant used was not known. Those raw materials were all available commercially.

As is shown in the examples, each grease according to the present invention did not develop much initial leakage and exhibited long life under high-temperature and high-speed conditions. In addition, no initial seizure occurred under high load and premature bearing flaking was not observed. Further, good rust inhibiting property was indicated. In Comparative Example 1, on the other hand, seizure occurred in an early stage under high load conditions because the end groups of the diurea as a thickener consisted of aromatic groups only. In Comparative Examples 2–4, the end groups contained many aliphatic groups or did not consist predominantly of aromatic groups so that, under high-temperature and high-speed conditions, substantial initial leakage took place and no satisfactory lubricating life was obtained. The content of the urea-type thickener was low in Comparative Examples 3 and 4 out of these comparative examples, whereby the possibility of flaking increased. In Comparative Examples 7 and 8, the lubricating life was short under high-temperature and high-speed conditions because each base oil consisted of the poly-α-olefin only. In Comparative Examples 5 and 10, the greases had poor bearing start-up performance at low temperatures and were not practically usable because the base oil was too high in kinematic viscosity or too low in thickness and was too hard. In contrast, the grease was so soft in Comparative Example 9 that the initial leakage was large and the lubricating life was short, and flaking was also observed because the content of the thickener was low. In Comparative Example 11 in which lithium soap was used as a thickener, under high-temperature and high-speed conditions, the leakage was large, the lubricating life was extremely short and, due to the lack of protecting effects for the rolling surface of the bearing by the urea compound, substantial flaking took place accordingly.

In the bearing rust inhibition tests, compositions similar to that of the present invention except for the elimination of one ingredient and compositions outside the present invention were tested in Comparative Examples 5–9. In each of these comparative example, marked rusting was observed under such severe conditions.

TABLE 1(1)

| | | Example 1 | Example 2 | Example 3 | Example 4 | Example 5 |
|---|---|---|---|---|---|---|
| Thickener | | | | | | |
| Diisocyanate | TDI | 210.8 g | 219.8 g | 226.0 g | 229.8 g | — |
| | MDI | — | — | — | — | 262.4 g |
| Monoamine | D-Toluidine | 246.6 g | 243.4 g | 250.4 g | 197.8 g | 179.8 g |
| | Stearylamine | 32.6 g | — | — | — | — |
| | Laurylamine | — | 40.8 g | — | — | 77.8 g |
| | Octylamine | — | — | 33.6 g | 102.4 g | — |
| Base oil | | | | | | |
| Alkyldiphenyl ether | | 1420.0 g | 695.0 g | 1400.0 g | 1370.0 g | 1390.0 g |
| Poly-alpha-olefin A | | — | 278.0 g | — | — | — |
| Poly-alpha-olefin B | | — | 417.0 g | — | — | — |
| Rust inhibitor | | | | | | |
| Organosulfonate (oil-soluble rust inhibitor) | | $NH_4$-sulfonate 20.0 g | $NH_4$-sulfonate 20.0 g | $NH_4$-sulfonate 20.0 g | Zn-sulfonate 20.0 g | Zn-sulfonate 20.0 g |
| nitrite (water-soluble rust inhibitor) | | Sodium nitrite 10.0 g | Sodium nitrite dispersion 20.0 g | Sodium nitrite 10.0 g | Sodium nitrite dispersion 20.0 g | Sodium nitrite 10.0 g |
| Non-ionic surfactant (HLB in parentheses) | | Sorbitan trioleate (1.8) 20.0 g | Sorbitan trioleate (1.8) 20.0 g | Sorbitan trioleate (3.0) 20.0 g | Sorbitan trioleate (3.0) 20.0 g | Sorbitan trioleate (3.0) 20.0 g |

TABLE 1(2)

| | Example 1 | Example 2 | Example 3 | Example 4 | Example 5 |
|---|---|---|---|---|---|
| Proportion of aromatic hydrocarbon groups in $R_1$ and $R_3$, mole % | 95 | 90 | 90 | 70 | 80 |
| Amount of thickener, wt. % | 24.5 | 25.5 | 25.5 | 26.5 | 26.0 |
| Kinematic viscosity of base oil, cSt at 40° C. | 97.0 | 94.0 | 97.0 | 97.0 | 97.0 |
| Mixing thickness (NLGI grade) | 278 (No. 2) | 284 (No. 2) | 281 (No. 2) | 288 (No. 2) | 286 (No. 2) |
| Leakage at high temperature and high speed, wt. % | 6.0 | 7.1 | 6.8 | 8.0 | 7.3 |
| Durability at high temperature and high speed, hrs | 1000 (passed) | 1000 (passed) | 1000 (passed) | 1000 (passed) | 1000 (passed) |
| Durability and anti-flaking under high load, hrs | 1000 (passed) | 1000 (passed) | 1000 (passed) | 1000 (passed) | 1000 (passed) |
| n = 5, | 1000 (passed) | 1000 (passed) | 1000 (passed) | 1000 (passed) | 1000 (passed) |
| *anti-seizure life, | 1000 (passed) | 1000 (passed) | 1000 (passed) | 1000 (passed) | 1000 (passed) |
| **anti-flaking life | 1000 (passed) | 1000 (passed) | 1000 (passed) | 1000 (passed) | 1000 (passed) |
| Start-up torque at −40° C. | Passed | Passed | Passed | Passed | Passed |
| Rust inhibition of bearing | Passed | Passed | Passed | Passed | Passed |

TABLE 2(1)

| | | Example 6 | Example 7 | Example 8 | Example 9 | Example 10 |
|---|---|---|---|---|---|---|
| Thickener | | | | | | |
| Diisocyanate | TDI | 199.6 g | 195.0 g | 212.7 g | 248.2 g | 260.2 g |
| | MDI | 31.8 g | — | — | — | — |
| Monoamine | D-Toluidine | 245.6 g | 216.0 g | 235.7 g | 274.9 g | 223.9 g |
| | Stearylamine | — | — | — | — | — |
| | Laurylamine | — | — | — | — | — |
| | Octylamine | 33.0 g | 29.0 g | 31.6 g | 36.9 g | 115.9 g |
| Base oil | | | | | | |
| Alkyldiphenyl ether | | 1380.0 g | 949.0 g | 1430.0 g | 1350.0 g | 650.0 g |
| Poly-alpha-olefin A | | — | 511.0 g | — | — | 260.0 g |
| Poly-alpha-olefin B | | — | — | — | — | 390.0 g |
| Rust inhibitor | | | | | | |
| Organosulfonate (oil-soluble rust inhibitor) | | Zn-sulfonate 20.0 g | Zn-sulfonate 20.0 g | Ba-sulfonate 10.0 g | Ba-sulfonate 20.0 g | Ba-sulfonate 20.0 g |
| nitrite (water-soluble rust inhibitor) | | Sodium nitrite dispersion 20.0 g | Sodium nitrite dispersion 20.0 g | Sodium nitrite 10.0 g | Sodium nitrite 10.0 g | Sodium nitrite dispersion 20.0 g |
| Non-ionic surfactant (HLB in parentheses) | | Polyoxyethylene ester (8.4) 20.0 g | Sorbitan trioleate (3.0) 20.0 g | Sorbitan trioleate (3.0) 20.0 g | Polyoxyethylene ester (8.4) 20.0 g | Sorbitan trioleate (1.8) 20.0 g |

TABLE 2(2)

| | Example 6 | Example 7 | Example 8 | Example 9 | Example 10 |
|---|---|---|---|---|---|
| Proportion of aromatic hydrocarbon groups in $R_1$ and $R_3$, mole % | 90 | 90 | 90 | 90 | 70 |
| Amount of thickener, wt. % | 25.5 | 22.0 | 24.0 | 28.0 | 30.0 |
| Kinematic viscosity of base oil, cSt at 40° C. | 97.0 | 155.0 | 97.0 | 97.0 | 94.0 |
| Mixing thickness (NLGI grade) | 283 (No. 2) | 330 (No. 1) | 310 (No. 1) | 250 (No. 3) | 225 (No. 3) |
| Leakage at high temperature and high speed, wt. % | 6.9 | 15.7 | 8.2 | 6.3 | 6.0 |
| Durability at high temperature and high speed, hrs | 1000 (passed) | 1000 (passed) | 1000 (passed) | 1000 (passed) | 1000 (passed) |
| Durability and anti-flaking under high load, hrs | 1000 (passed) | 1000 (passed) | 1000 (passed) | 1000 (passed) | 1000 (passed) |
| n = 5, | 1000 (passed) | 1000 (passed) | 1000 (passed) | 1000 (passed) | 1000 (passed) |
| *anti-seizure life, | 1000 (passed) | 1000 (passed) | 1000 (passed) | 1000 (passed) | 1000 (passed) |

TABLE 2(2)-continued

| | Example 6 | Example 7 | Example 8 | Example 9 | Example 10 |
|---|---|---|---|---|---|
| **anti-flaking life | 1000 (passed) | 1000 (passed) | 1000 (passed) | 1000 (passed) | 1000 (passed) |
| Start-up torque at −40° C. | Passed | Passed | Passed | Passed | Passed |
| Rust inhibition of bearing | Passed | Passed | Passed | Passed | Passed |

TABLE 3(1)

| | | Comp. Ex. 1 | Comp. Ex. 2 | Comp. Ex. 3 | Comp. Ex. 4 | Comp. Ex.5 |
|---|---|---|---|---|---|---|
| Thickener | | | | | | |
| Diisocyanate | TDI | 219.6 g | 220.6 g | — | — | 226.0 g |
| | MDI | — | — | 167.4 g | 108.2 g | — |
| Monoamine | D-Toluidine | 270.4 g | 135.7 g | — | — | 250.4 g |
| | CHA | — | — | 132.6 g | — | — |
| | Octylamine | — | 163.7 g | — | 111.8 g | 33.6 g |
| Base oil | | | | | | |
| Alkyldiphenyl ether | | 1420.0 g | 1390.0 g | 1600.0 g | 1690.0 g | 695.0 g |
| Poly-alpha-olefin A | | — | — | — | — | 695.0 g |
| Poly-alpha-olefin B | | — | — | — | — | — |
| Rust inhibitor | | | | | | |
| Oil-soluble rust inhibitor | | $NH_4$-sulfonate 20.0 g | Zn-sulfonate 20.0 g | Zn-sulfonate 20.0 g | Ba-sulfonate 20.0 g | — |
| Water-soluble rust inhibitor | | Sodium nitrite 10.0 g | Sodium nitrite 10.0 g | Sodium nitrite dispersion 20.0 g | Sodium nitrite 10.0 g | Sodium nitrite dispersion 30.0 g |
| Non-ionic surfactant (HLB in parentheses) | | Sorbitan trioleate (3.0) 20.0 g | Sorbitan trioleate (1.8) 20.0 g | Sorbitan trioleate (3.0) 20.0 g | Sorbitan trioleate (3.0) 20.0 g | Sorbitan trioleate (3.0) 20.0 g |

TABLE 3(2)

| | Comp. Ex. 1 | Comp. Ex. 2 | Comp. Ex. 3 | Comp. Ex. 4 | Comp. Ex. 5 |
|---|---|---|---|---|---|
| Proportion of aromatic hydrocarbon groups in $R_1$ and $R_3$, mole % | 100 | 50 | 0 | 0 | 90 |
| Amount of thickener, wt. % | 24.5 | 26.0 | 15.0 | 11.0 | 25.5 |
| Kinematic viscosity of base oil, cSt at 40° C. | 97.0 | 97.0 | 97.0 | 97.0 | 190.0 |
| Mixing thickness (NLGI grade) | 274 (No. 2) | 288 (No. 2) | 287 (No. 2) | 269 (No. 2) | 272 (No. 2) |
| Leakage at high temperature and high speed, wt. % | 5.4 | 21.3 | 36.8 | 39.2 | 6.5 |
| Durability at high temperature and high speed, hrs | 1000 (passed) | 660 | 480 | 420 | 1000 (passed) |
| Durability and anti-flaking under high load, hrs | 200* | 1000 (passed) | 230** | 180** | 1000 (passed) |
| n = 5, | 280* | 1000 (passed) | 1000 (passed) | 200** | 1000 (passed) |
| *anti-seizure life, | 340* | 1000 (passed) | 1000 (passed) | 1000 (passed) | 1000 (passed) |
| **anti-flaking life | 500* | 1000 (passed) | 1000 (passed) | 1000 (passed) | 1000 (passed) |
| Start-up torque at −40° C. | 720* | 1000 (passed) | 1000 (passed) | 1000 (passed) | 1000 (passed) |
| Rust inhibition of bearing | Passed | Passed | Passed | Passed | Failed |
| | Passed | Passed | Passed | Passed | Failed |

TABLE 4(1)

| | | Comp. Ex. 6 | Comp. Ex. 7 | Comp. Ex. 8 | Comp. Ex. 9 | Comp. Ex. 10 | Comp. Ex. 11 |
|---|---|---|---|---|---|---|---|
| Thickener | | | | | | | |
| Diisocyanate | TDI | 226.0 g | 226.0 g | 226.0 g | 177.2 g | 288.1 g | Lithium stearate |
| | MDI | — | — | — | — | — | |

TABLE 4(1)-continued

| | | Comp. Ex. 6 | Comp. Ex. 7 | Comp. Ex. 8 | Comp. Ex. 9 | Comp. Ex. 10 | Comp. Ex. 11 |
|---|---|---|---|---|---|---|---|
| Monoamine | D-Toluidine | 250.4 g | 250.4 g | 250.4 g | 196.4 g | 319.1 g | 500.0 g |
| | CHA | — | — | — | — | — | |
| | Octylamine | 33.6 g | 33.6 g | 33.6 g | 26.4 g | 42.8 g | |
| Base oil | | | | | | | |
| Alkyldiphenyl ether | | — | 834.0 g | — | 1500.0 g | 1260.0 g | 1410.0 g |
| Poly-alpha-olefin A | | 556.0 g | — | — | — | — | — |
| Poly-alpha-olefin B | | 834.0 g | 556.0 g | 1390.0 g | — | — | — |
| Rust inhibitor | | | | | | | |
| Oil-soluble rust inhibitor | | Zn-sulfonate 30.0 g | Ba-sulfonate 30.0 g | Alkenylsuccinic anhydride 20.0 g | $NH_4$-sulfonate 20.0 g | Ba-sulfonate 20.0 g | Zn-sulfonate 20.0 g |
| Water-soluble rust inhibitor | | — | Sodium nitrite dispersion 30.0 g | Sodium nitrite dispersion 20.0 g | Organic acid amine salt 20.0 g | Sodium nitrite 10.0 g | Sodium nitrite 10.0 g |
| Non-ionic surfactant (HLB in parentheses) | | Sorbitan trioleate (3.0) 33.0 g | — | Sorbitan trioleate (3.0) 20.0 g | Sorbitan trioleate (3.0) 20.0 g | Polyoxyethylene ester (11.8) 20.0 g | Sorbitan trioleate (3.0) 20.0 g |

TABLE 4(2)

| | Comp. Ex. 6 | Comp. Ex. 7 | Comp. Ex. 8 | Comp. Ex. 9 | Comp. Ex. 10 | Comp. Ex. 11 |
|---|---|---|---|---|---|---|
| Proportion of aromatic hydrocarbon groups in $R_1$ and $R_3$, mole % | 90 | 90 | 90 | 90 | 90 | — |
| Amount of thickener, wt. % | 25.5 | 25.5 | 25.5 | 20.0 | 32.5 | 25.0 |
| Kinematic viscosity of base oil, cSt at 40° C. | 94.0 | 75.0 | 45.0 | 97.0 | 97.0 | 97.0 |
| Mixing thickness (NLGI grade) | 280 (No. 2) | 283 (No. 2) | 289 (No. 2) | 359 (No. 0) | 196 (No. 4) | 271 (No. 2) |
| Leakage at high temperature and high speed, wt. % | 6.8 | 6.9 | 7.0 | 43.6 | 4.5 | 68.3 |
| Durability at high temperature and high speed, hrs | 720 | 1000 (passed) | 480 | 320 | 1000 (passed) | 32 |
| Durability and anti-flaking under high load, hrs | 1000 (passed) | 180** | 160** | 220** | 1000 (passed) | 160** |
| n = 5, | 1000 (passed) | 220** | 180** | 1000 (passed) | 1000 (passed) | 200** |
| *anti-seizure life, | 1000 (passed) | 1000 (passed) | 210** | 1000 (passed) | 1000 (passed) | 210** |
| **anti-flaking life | 1000 (passed) | 1000 (passed) | 1000 (passed) | 1000 (passed) | 1000 (passed) | 1000 (passed) |
| Start-up torque at −40° C. | Passed | Passed | Passed | Passed | Failed | — |
| Rust inhibition of bearing | Failed | Failed | Failed | Failed | Passed | — |

We claim:

1. A grease composition for high-temperature, high-speed and high-load bearings, comprising:

(i) a lubricating base oil composed of an alkyldiphenyl ether lubricant as an essential ingredient and having a kinematic viscosity of 90–160 cSt at 40° C., and (ii) 24–30 wt. %, based on the grease composition, of a diurea compound as a thickener, said diurea compound being represented by the following formula:

$$R_1-NHC(=O)NH-R_2-NHC(=O)NH-R_3$$

wherein $R_2$ means an aromatic hydrocarbon group having 6–15 carbon atoms, $R_1$ and $R_3$ denote an aromatic hydrocarbon group having 6–12 carbon atoms or a linear alkyl group having 8–20 carbon atoms, and the proportion of aromatic hydrocarbon groups in $R_1$ and $R_3$ is 70–95 mole %; and the NLGI thickness grade of said composition being in a range of from No. 1 to No. 3.

2. The grease composition of claim 1, wherein the alkyldiphenyl ether lubricant is contained in an amount of at least 50 wt. % based on the lubricating base oil.

3. The grease composition of claim 1, wherein the diurea compound is contained in an amount of 24–28 wt. % based on the grease composition.

4. The grease composition of claim 1, wherein the grease composition has a thickness in a range of 310–250.

5. The grease composition of claim 1, wherein the diurea has been obtained by reacting a diisocyanate with a monoamine.

6. The grease composition of claim 5, wherein the diisocyanate is an aromatic isocyanate selected from the group consisting of 2,4-tolylene diisocyanate, 2,6-tolylene diisocyanate, diphenylmethane-4,4'-diisocyanate and naphthylene-1,5-diisocyanate and mixtures thereof, and the monoamine is selected from the group consisting of aniline, benzylamine, toluidine, chloroaniline, octylamine, nonylamine, decylamine, undecylamine, dodecylamine, tridecylamine, tetradecylamine, pentadecylamine, hexadecylamine, heptadecylamine, octadecylamine, nonyldecylamine and eicosylamine.

7. The grease composition of claim 1, further comprising a rust inhibiting additive composed of (i) an organosulfonate salt, (ii) a nitrite and (iii) a non-ionic surfactant, whose HLB is 1.5–9, each in an amount of 0.1–10 wt. % based on the grease composition.

8. The grease composition of claim 7, wherein the organosulfonate salt is represented by $RSO_3$-M in which $RSO_3$ is a residuum of a petroleum sulfonic acid or dinonylnaphthalenesulfonic acid and M is Ba, Ca, Zn, Pb, Na, Li, $NH_4^+$ or a residuum of $H_2N(CH_2)_2NH_2$.

9. The grease composition of claim 7, wherein the nitrite is sodium nitrite.

10. The grease composition of claim 7, wherein the non-ionic surfactant is a glycerin fatty acid ester, polyglycerin fatty acid ester, sorbitan fatty acid ester, pentaerythritol fatty acid ester, polyoxyethylene fatty acid ester, or polyoxyethylene alkylphenyl ether.

* * * * *